United States Patent [19]

Akers

[11] 4,328,962

[45] May 11, 1982

[54] MAIL SORTING MACHINE

[75] Inventor: Roy Akers, Lafayette County, Mo.

[73] Assignee: Bell & Howell Company, Chicago, Ill.

[21] Appl. No.: 218,274

[22] Filed: Dec. 19, 1980

Related U.S. Application Data

[63] Continuation of Ser. No. 48,798, Jun. 15, 1979, abandoned.

[51] Int. Cl.[3] ..... B65H 3/12; B65H 5/02; B65H 1/02

[52] U.S. Cl. ..... 271/12; 271/30 A; 271/31; 271/94; 271/150

[58] Field of Search ..... 271/5, 6, 4, 11, 12, 271/10, 94, 95, 96, 30 A, 30 R, 149, 150, 34, 35, 197, 276, 3, 7, 225, DIG. 9, 129, 126, 31, 2; 209/900; 414/330; 221/218, 279, 226, 231

[56] References Cited

U.S. PATENT DOCUMENTS

| | | | |
|---|---|---|---|
| 2,554,557 | 5/1951 | Lauffer | 271/2 |
| 2,977,114 | 3/1961 | Hanson et al. | 271/94 |
| 3,038,607 | 6/1962 | Eckert, Jr. | 209/111 |
| 3,162,438 | 12/1964 | Perry, Jr. | 271/214 |
| 3,368,672 | 2/1968 | Heaney et al. | 209/900 X |
| 3,386,574 | 6/1968 | Kaplan | 271/12 X |
| 3,617,051 | 11/1971 | McInerny | 271/149 |
| 3,691,726 | 9/1972 | Stephens et al. . | |
| 3,698,706 | 10/1972 | Mihojevich et al. | 271/276 X |
| 3,757,942 | 9/1973 | Gunn | 209/900 X |
| 3,938,435 | 2/1976 | Suda et al. | 209/900 X |
| 4,050,222 | 9/1977 | Stephens et al. . | |
| 4,147,252 | 4/1979 | Burkhardt | 209/900 X |

FOREIGN PATENT DOCUMENTS

| | | | |
|---|---|---|---|
| 628022 | 11/1961 | Italy | 271/34 |
| 1475178 | 6/1977 | United Kingdom | 271/35 |

*Primary Examiner*—Bruce H. Stoner, Jr.
*Attorney, Agent, or Firm*—Lowe, Kokjer, Kircher, Wharton & Bowman

[57] ABSTRACT

The envelope feeder apparatus of the present invention is suitable for use with conventional mail sorting machines. The envelope feeder apparatus is capable of receiving a supply of envelopes on a feeder magazine which is incorporated into the body of the apparatus. The individual envelopes are picked off in succession at a feeder station by means of a suction device which operates in combination with a pair of conveying belts having a friction surface facing the incoming envelopes. The suction device acts through holes in the conveying belts to draw the lead envelope against the friction surface of the conveying belts for separation of the lead envelope from the rest of the supply. The separated envelope is then conveyed through an arcuate path and introduced into a transport channel which is positioned parallel to the feeder magazine of the apparatus. Within the transport channel, the envelope is transferred to a read station where the envelope is held in a stationary position until a sort code or other identifying data on the envelope is read by the operator of the apparatus. At the read station, the envelope is held in a stationary position such that the operator of the apparatus has an unobstructed view of the side surface of the envelope. From the rear station, the envelope is advanced to the sort bins of the machine through a transport channel which is also parallel to the feeder magazine.

28 Claims, 9 Drawing Figures

MAIL SORTING MACHINE

This is a continuation of application Ser. No. 048,798 filed June 15, 1979 now abandoned.

BACKGROUND AND BRIEF DESCRIPTION OF THE INVENTION

This invention relates in general to the handling of mail and, in particular, to an improved envelope feeder apparatus for use with mail sorting machines.

The volume of mail handled daily by large businesses, institutions and governmental entities has steadily increased through the years. For example, credit card companies, utilities, mail order houses and other advertisers send and receive huge quantities of mail daily. Typically, the envelopes containing the material to be mailed are addressed and then sorted into common groups for mailing. Similarly, mail received by such entities is commonly sorted into groups based on the subject matter of the received material. This ever increasing volume of mail has created a corresponding need to develop new techniques and machines for conveniently handling and sorting the incoming and/or outgoing mail handled by such entities.

Several different types of machines have been developed to assist in the handling and sorting of mail. These prior art mail sorting machines are typically comprised of an envelope feeder apparatus and a storage apparatus. The feeder apparatus normally includes a feed station where the envelopes of an incoming supply are separated from each other and a read station where the separated envelopes are held in a stationary position while the operator of the machine reads a sort code or other identifying data which is imprinted on the envelope. The storage apparatus, on the other hand, is usually comprised of a plurality of sort bins and means for directing an envelope into its appropriate sort bin.

None of these prior art machines, however, have proved to be totally satisfactory for several reasons. One of the most notable problems associated with existing mail sorting machines is that they occupy a large amount of room due to the manner in which they are constructed. In particular, these prior art machines are constructed to have an envelope feeder apparatus wherein the incoming envelopes are carried by a feed magazine which is oriented perpendicular to the direction in which the envelopes travel through the apparatus. As a result, the magazine extends outward from the main body of the apparatus at a right angle therewith. While this type of design facilitates separation of the incoming envelopes, it also makes the machine rather bulky because the feed magazine typically extends outward from the main body of the apparatus quite a distance.

Another problem associated with these prior art machines is that the operator does not have an unobstructed view of an envelope when it is positioned at the read station of the feeder apparatus. In addition, existing mail sorting machines tend to be unreliable and often fail to properly separate consecutive envelopes thereby causing two envelopes to be conveyed through the machine together and improperly deposited in the same sorting bin.

The present invention provides a unique envelope feeder apparatus which is suitable for use with conventional mail sorting machines. The feeder apparatus herein disclosed includes a feed station where the incoming envelopes are separated from each other and a read station where an envelope is held while the sort code or other identifying data is read by an operator. In this apparatus, the incoming stack of envelopes is conveyed to the feed station by means of a feed magazine which is positioned parallel to the flow of mail through the apparatus. By orienting the feed magazine parallel to the path followed by mail through the feeder apparatus, the amount of area occupied by the apparatus is greatly reduced because the feed magazine may be incorporated into the body of the apparatus rather than extending outward therefrom.

At the feed station, the lead envelope is separated from the remainder of the stack. The separated envelope is then conveyed through an arcuate path and introduced into a transport channel for conveyance to the read station. To facilitate movement of the separated envelope through this arcuate path, the envelopes are delivered to the feed station in an oblique orientation to thereby decrease the angle through which the envelopes must be moved to introduce them into the transport channel.

As suggested above, the envelope is held at the read station such that the operator has an unobstructed view of the entire side surface of the envelope while reading the sort code or other identifying data thereon. Once the sort code has been read by the operator, the operator makes ae entry which provides the machine with information concerning the sort bin in which this envelope is to be deposited. Upon receipt of this entry, the machine advances the envelope from the read station into a guideway for transfer to its designated sort bin.

It is therefore an object of the present invention to provide an envelope feeder apparatus for a mail sorting machine wherein the incoming stack of envelopes is delivered to the feed station of the apparatus by means of a feed magazine uniquely positioned generally parallel to the path followed by envelopes through the apparatus.

Another object of the present invention is to provide an envelope feeder apparatus for a mail sorting machine wherein the separated envelopes are held in a stationary position and at the read station of the apparatus such that an operator has an unobstructed view of the entire side surface of the envelope.

An additional object of the present invention is to provide an envelope feeder apparatus of the character described which is more compact than presently existing devices.

A further object of the present invention is to provide an envelope feeder apparatus of the character described which is not only extremely reliable, but also simple and economical to construct and operate.

Another object of the present invention is to provide a mail sorting machine of the character described wherein the envelopes are conveyed and handled in a reliable manner without being subject to folding, tearing or other damage.

Other and further objects of this invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are employed to indicate like parts in the various views.

Figure 1:
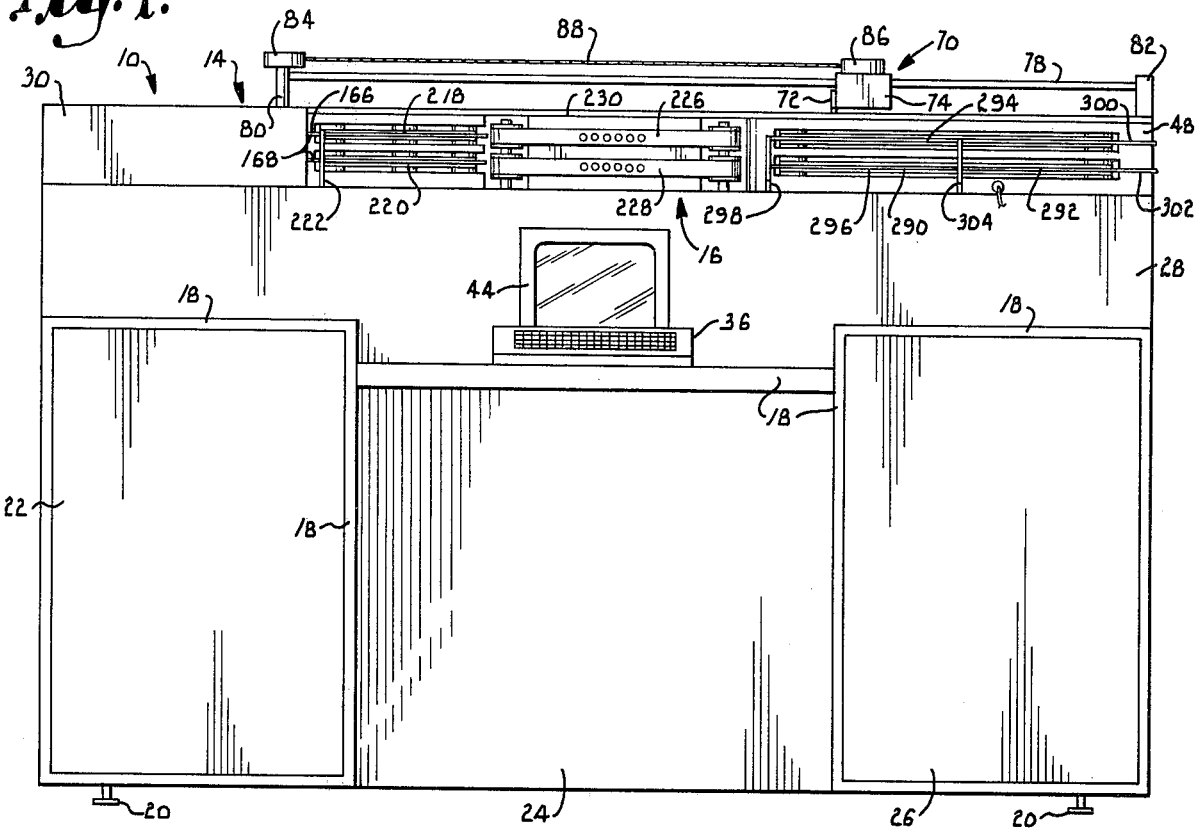
FIG. 1 is a front elevational view of an envelope feeder apparatus constructed according to a preferred embodiment of the present invention.
Figure 2:
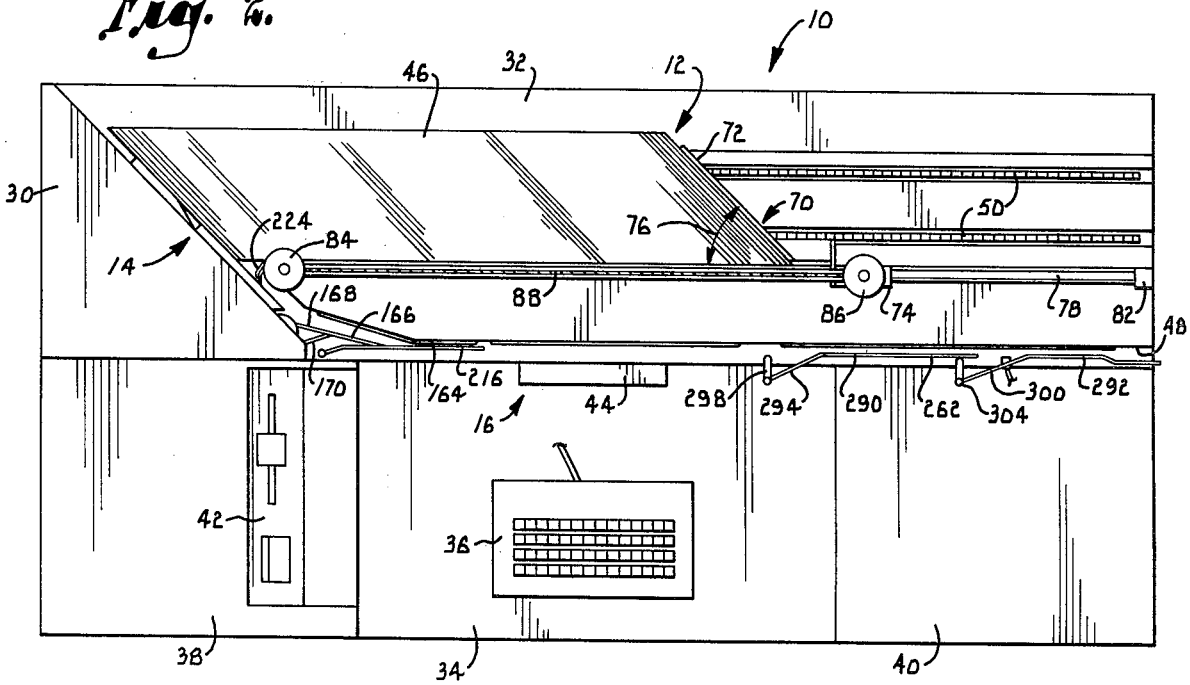
FIG. 2 is a top plan view of the envelope feeder apparatus shown in FIG. 1.
Figure 3:
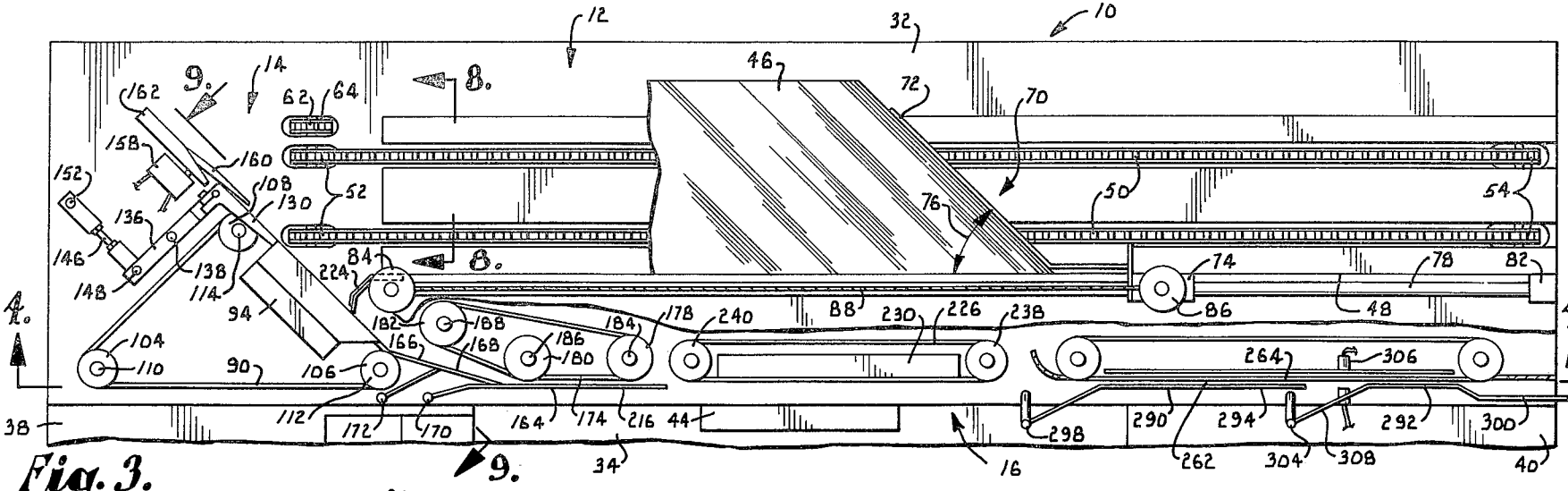
FIG. 3 is an enlarged, fragmentary top plan view of the envelope feeder apparatus, with portions broken away for the purposes of illustration.

Reference is now made to the drawings in detail and initially to FIGS. 1, 2 and 3 wherein the numeral 10 is used to designate an envelope feeder apparatus which is constructed in accordance with a preferred embodiment of the present invention. The feeder apparatus of the present invention includes a feeder magazine 12 for receiving the mail to be sorted, a feed station 14 for separating the incoming mail and a read station 16 for holding the envelope while the sort code or other identifying data is read by the operator of the machine.

The envelope feeder apparatus shown herein is suitable for use in a conventional mail sorting machine. When this apparatus is incorporated into a mail sorting machine, the storage apparatus of the machine is attached to the right side of the feeder apparatus shown herein in a manner which is well known to those of ordinary skill in the art. The storage apparatus of such a machine is typically comprised of a plurality of sort bins for receiving and storing the sorted envelopes and means for directing each envelope to its appropriate sort bin. The specific design of the storage apparatus can take many different forms which are well known to those of ordinary skill in the art. One such storage apparatus which is well suited for use in combination with the envelope feeder apparatus of the present invention is given and described in the commonly owned U.S. patent application entitled "Improved Mail Sorting Machine", filed by Roy Akers on Dec. 28, 1978, and given Ser. No. 973,926, now U.S. Pat. No. 4,275,875. Another such storage apparatus is given and described in U.S. Pat. No. 3,574,328 which was issued to William E. Holmes on Apr. 13, 1971. Both of these patents are incorporated herein by reference.

The feeder apparatus is constructed of a structural frame 18 which is supported by a plurality of legs 20 having feet which rest on the floor or other support surface. A plurality of panels 22, 24, 26, 28, 30 and 32 are provided to enclose the operating components of the apparatus. Panels 22 and 26 are spaced apart from each other and panel 24 is set back from panels 22 and 26 to provide a recess which is sufficient to accomodate a chair and the legs of the operator of the machine.

A horizontal table 34 is carried by the structural frame above panel 24. A keyboard device 36 rests upon table 34 to provide sort instructions to the machine's control circuitry. Additional work space is provided by a pair of horizontal tables 38 and 40 which are carried by the machine's structural frame above panels 22 and 26, respectively. The apparatus is also equipped with a conventional printing device 42 and a CRT display device 44 for outputting data from the control circuitry of the apparatus.

Magazine 12 is incorporated into the body of the apparatus and is positioned to be parallel with the path followed by envelopes through the apparatus. Magazine 12 presents a flat horizontal surface for receiving a supply of envelopes 46 which are to be sorted by the machine. The envelopes are placed on the magazine with the large flat front and back surface of the envelopes disposed against one another and with each envelope occupying a substantially vertical plane. The envelopes are positioned on the magazine so that the front surface of each envelope faces toward the feed station and the lower edge of the envelope rests on the upper surface of the magazine. A guide wall 48 protrudes upward from the flat surface of the magazine to provide a guide for aligning the envelopes with respect to the feed station. When the envelopes are properly positioned on the magazine, the short edge of the envelope is in contact with this wall to ensure that the envelopes are properly positioned with respect to the feed station.

The envelopes are advanced along the magazine toward the feed station by means of a pair of parallel conveyor chains 50. Each conveyor chain is carried by a driven sprocket 52 and an idler sprocket 54. Drive sprockets 52 are driven by an electric motor 56 in a direction which causes the upper surface of the conveyor chains to move forwardly along the top surface of the magazine thereby advancing envelopes 46 toward the feed station of the apparatus.

Figure 4:
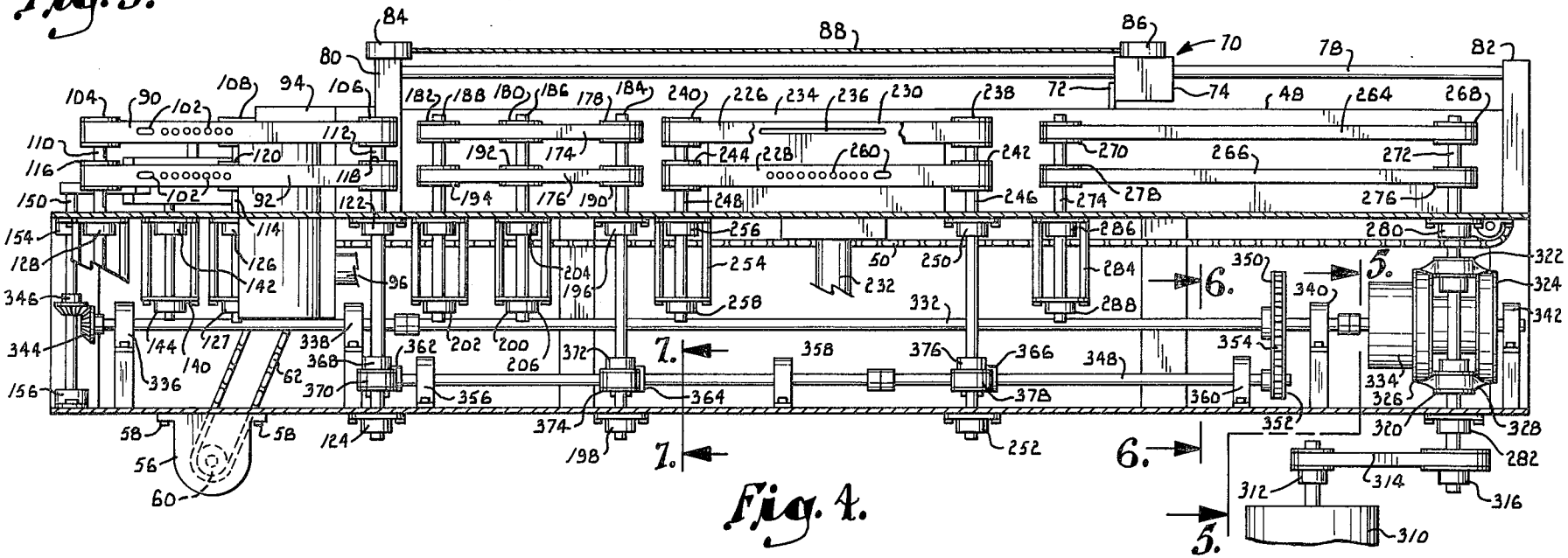
FIG. 4 is a sectional view taken along line 4—4 of FIG. 3 in the direction of the arrows.
Figure 8:
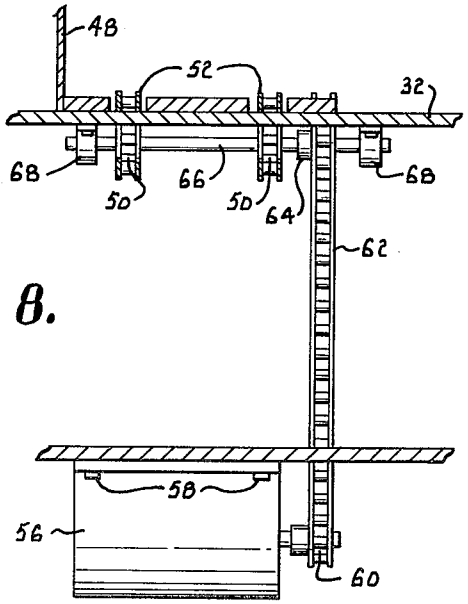
FIG. 8 is a fragmentary sectional view on an enlarged scale taken along line 8—8 of FIG. 3 in the direction of the arrows.
Figure 6:
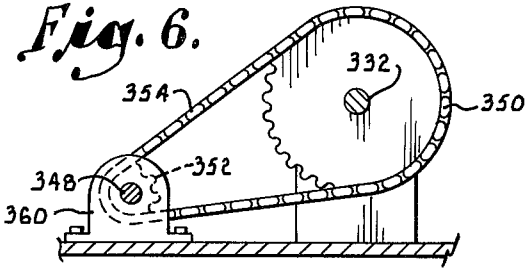
FIG. 6 is a fragmentary sectional view on an enlarged scale taken along line 6—6 of FIG. 4 in the direction of the arrows.

Referring now to FIGS. 3, 4, and 8 in particular, electric motor 56 is mounted to the frame of the feeder apparatus by means of mounting screws 58. This motor has a drive sprocket 60 mounted on its drive shaft. A drive chain 62 is in turn passed around sprocket 60 and around a sprocket 64 which is carried by a horizontal shaft 66. Driven sprockets 52 are also mounted onto shaft 66 in spaced apart relationship from each other. A pair of flanged bearings 68 are used to rotatably couple shaft 66 to the frame of the apparatus. The idler sprockets are likewise mounted onto a common shaft which is similarly mounted onto the frame of the apparatus.

As shown in FIGS. 1, 2, 3 and 4, a carriage assembly 70 is provided to maintain the envelopes in a vertical orientation upon the feed magazine. The carriage assembly is basically comprised of a support platen 72 and a guide piece 74. Platen 72 is attached to the guide piece 74 at acute angle 76 (See FIG. 2) with guide wall 48 of the apparatus. In operation, support platen 72 rests against the last envelope of the stack and causes the envelopes to be maintained on the feed magazine in a slanted orientation with the angle of the envelopes relative to guide wall 48 being established by support platen 72. Guide block 74, on the other hand, is arranged to ride on a guide rail 78 which is carried in spaced apart relationship from guide wall 48 by means of support post 80 and 82 (see FIGS. 1 & 4). In particular, guide rail 78 is comprised of a length of tubular metal which passes through a corresponding opening in the guide block 74. A cable 88 under rewind bias by mechanisms 84 and 86 are used to advance the carriage assembly forward in conjunction with the envelope stack to thereby maintain the support platen 72 in pressure contact with the flat side surface of the last envelope of the stack. Cable 88 pulls mechanism 86 (and block 74) forwardly under an appropriate bias to thereby drive the carriage assembly forward and maintain the envelope stack in proper vertical and angular orientation (as will be described).

Referring now to FIGS. 1, 2, 3, 4 and 9, the carriage assembly advances the envelope supply along feeder magazine 12 to bring the leading envelope of the stack into position at feed station 14. The feed station is equipped with a pair of conveying belts 90 and 92 (but seen in FIGS. 4 and 9) which cooperate with a suction box 94 to pick off the leading envelope of the stack and convey it away from the remainder of the stack. Suction box 94 is coupled with a conventional vacuum pump (not shown) by means of a hose 96. The vacuum pump is operable to maintain a low pressure within the box.

Figure 9:
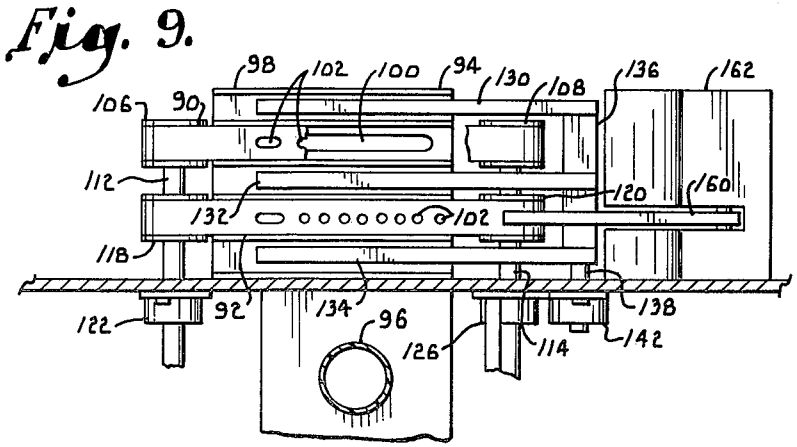
FIG. 9 is a fragmentary sectional view on an enlarged scale taken along line 9—9 of FIG. 3 in the direction of the arrows.

As shown in FIG. 9, suction box 94 is constructed to have a face plate 98 which has a pair of suction openings defined therein. The suction openings constitute elongated openings cut in the face plate of the suction box. These openings are spaced apart from each other and are arranged in a parallel orientation. One of these suction openings in shown in FIG. 9 and is designated by the numeral 100. The other suction opening is directly behind belt 92 and, as a result, cannot be seen in this figure. The suction box is mounted onto the structural frame of the apparatus so that the suction openings are positioned to face the incoming envelope supply such that at least a portion of each opening overlaps the front flat surface of the leading envelope.

Conveying belts 90 and 92 are respectively positioned over the suction openings in the face plate of suction box 94 to present a friction surface to the leading envelope of the incoming stack. Each conveying belt is periodically provided with a plurality of holes which are represented by the numeral 102. The holes in each of the conveying belts are similarly positioned so that each grouping of holes on one belt is aligned with its corresponding grouping of holes on the other belt as shown in FIGS. 4 and 9.

Conveying belt 90 is drawn tightly around pulleys 104, 106, and 108 which are mounted on vertical shafts 110, 112 and 114, respectively. Conveying belt 92, on the other hand, is mounted in parallel with belt 90 by means of three pulleys 116, 118 and 120 which are mounted on shafts 110, 112 and 114, respectively. Vertical shafts 110, 112 and 114 are in turn rotatably mounted onto the frame of the apparatus by means of flanged bearings such as 122, 124, 126, 127 and 128.

Referring now primarily to FIGS. 3 and 9, a plurality of jogger arms 130, 132 and 134 are provided to facilitate separation of the envelopes at the feed station. The jogger arms are suitably attached to a pivot piece 136. Pivot piece 136 is pivotally coupled with the frame of the apparatus by means of a vertical shaft 138. In particular, the pivot place is fixedly secured to shaft 138 which is in turn rotatably coupled to the frame of the apparatus by means of a mounting assembly 140. This mounting assembly is comprised of a pair of flanged bearings 142 and 144 which are commonly mounted to the structural frame of the apparatus in a spaced apart relationship from each other. A bell crank arm 146 is pivotally coupled with pivot piece 136 by means of a pivot pin 148 to impart movement to the pivot piece about its pivot point 138. The other end of the bell crank arm is rotatably coupled with a drive shaft 150 in an eccentric manner by means of a pin 152. Drive shaft 150 is in turn rotatably coupled with the frame by means of a pair of flanged bearings 154 and 156. By eccentrically coupling the bell crank arm 146 to drive shaft 150, rotatable movement of the shaft causes the pivot piece 136 to continuously pivot about shaft 138. This pivotal movement of the pivot piece in turn causes the jogger arms to oscillate between a retracted position wherein each jogger arm sits within a corresponding recess in the face plate of the suction box behind the friction surface of the conveying belts and an extended position wherein the arms protrude outward from the conveying belts to push the entire stack of mail back away from the friction surface of each belt.

A switch mechanism 158 having a contact arm 160 is provided to control the operation of motor 56 which drives the conveyor chains 50. This switch is mounted to panel 32 behind a guide plate 162 which is attached to the floor of the magazine to extend upward therefrom at a right angle therewith. Contact arm 160 is hingedly secured to guide plate 162 and is used to control the condition of switch 158. The switch is located and oriented such that the incoming envelopes are capable of contacting and moving contact arm 160 to a "off" position whenever an envelope is properly positioned at the feed station. When contact arm 160 is in a "off" position, the switch mechanism is maintained in a "off" condition and motor 56 remains deenergized. When enough envelopes have been picked off the front of the stack so that there is no longer an envelope in position at the feed station, contact arm 160 is allowed to return to an "on" position which in turn causes motor 56 to be energized. In this way, conveyor chains 50 are intermittently driven in a forward direction to locate the leading envelope of the stack at the feed station so that it may be picked off by the suction device and conveying belts.

Referring now to FIGS. 1, 2, 3 and 4, conveying belts 90 and 92 contact the front surface of the leading envelope to introduce this envelope into a transport channel 164 for conveyance to the read station of the apparatus. The envelopes are directed from the feed station into the transport channel by means of a guide rail 166. The individual bars of the guide rails are comprised of a pair of elongated metal bars 168 which are spaced apart from each other in a parallel relationship. The guide rails are in turn mounted to the structural frame of the machine by means of support bars 170 and a mounting post 172.

The envelopes are advanced to the feed station through transport channel 164 by means of a pair of conveying belts 174 and 176. Belt 174 is tightly drawn around a plurality of pulleys 178, 180 and 182 which are mounted on shafts 184, 186 and 188 respectively. Belt 176, on the other hand, is mounted in parallel with belt 174 by means of pulleys 190, 192 and 194 which are carried by vertical shafts 184, 186 and 188, respectively. Vertical shaft 184 is rotatably mounted to the frame of the machine by means of a pair of flanged bearings 196 and 198. Shafts 186 and 182 are mounted onto the frame of the machine by means of mounting assemblies 200 and 202, respectively. Since both of these mounting assemblies are identical in design, only mounting assembly 200 will be described in detail herein. This mounting assembly is comprised of a pair of flanged bearings 204 and 206 which are commonly mounted to the structural frame of the machine in spaced apart relationship from each other. These flanged bearings are mounted to the frame of the machine by means of mounting screws 208 and 210 and are separated apart from each other by means of tubular sleeves 212 and 214.

A biasing rail 216 is provided to hold the envelopes against conveying belt 174 and 176 as they move through transport channel 164. As shown in FIG. 1, biasing rail 216 is comprised of a pair of elongated tubular bars 218 and 220 which are located adjacent to belts 174 and 176. These metal bars are attached in parallel to a mounting post 222 which is in turn anchored to the structural frame of the machine.

As shown in FIGS. 2 and 3, a forwardly projecting finger 224 is appropriately located between the feed station and transport channel 164 to pick off any envelopes that may stick to the backside of the leading envelope. The finger is comprised of a plurality of leaf springs which are secured to each other and to the structural frame of the apparatus.

Reference is now made to FIGS. 1, 2, 3 and 4 for a more detailed description of the read station 16 of the apparatus. The read station is basically comprised of a pair of conveying belts 226 and 228 and a suction box 230. Suction box 230 is comprised of a hollow box which is mounted onto the frame of the apparatus adjacent to conveying belts 174 and 176. The suction box is coupled with a vacuum pump by means of a hose 232. The suction box is provided with the face plate 234 which has a pair of suction openings defined therein. The suction openings are comprised of elongated slots cut in the face plate of the suction box. One of these openings is shown in FIG. 4 and is designated by the numeral 236. The other opening is just below opening 236 and lies behind belt 228.

Conveying belt 226 is carried by pulleys 238 and 240 such that it completely encircles suction box 230. Conveying belt 228 is similarly carried by pulleys 242 and 244. Pulleys 238 and 242 are mounted on a drive shaft which is designated by the numeral 246 while pulleys 240 and 244 are mounted on an idler shaft which is designated by the numeral 248. Drive shaft 246 is in turn rotatably coupled to the structural frame of the apparatus by means of a pair of flanged bearings 250 and 252. Idler shaft 248, on the other hand, is rotatably mounted to the structural frame of the apparatus by means of a mounting assembly 254 which is comprised of a pair of flanged bearings 256 and 258 which are commonly mounted to the structural frame of the apparatus in spaced apart relationship from each other. This mounting assembly is similar in construction to mounting assembly 200 which was described above.

Each conveying belt is provided with a plurality of holes which are represented by the numeral 260. The holes in each of the conveying belts are grouped together and aligned so that a grouping of holes in one of the belts is aligned with a corresponding grouping of holes in the other belt. The conveying belts are located in front of the suction openings in the face plate of suction box 230 and present a friction surface which is coplanar with the friction surface presented by the outer portion of belt 174 between pulleys 178 and 180 and the outer portion of belt 176 between pulleys 190 and 192.

Envelopes are driven out of the apparatus from the read station by means of a second transport channel 262. The envelopes are conveyed through transport channel 262 by means of a pair of conveying belts 264 and 266. Belt 264 is drawn tightly around a pair of pulleys 268 and 270 which are respectively carried by a drive shaft 272 and idler shaft 274. Belt 266, on the other hand, is drawn around a pair of pulleys 276 and 278 which are also carried on surface 272 and 274, respectively. Vertical shafts 272 and 274 are rotatably mounted to the support structure of the apparatus such that the outer surface of each belt presents a friction surface with is coplanar with the outer surface of belts 226 and 228. In particular, vertical shaft 272 is rotatably mounted to the structural frame of the machine by means of a pair of flanged bearings 280 and 282. Idler shaft 274, on the other hand, is rotatably mounted onto the structural frame of the machine by means of a mounting assembly 284. Mounting assembly 284 is comprised of a pair of flanged bearings 286 and 288 which are commonly mounted to the frame of the apparatus in spaced apart relationship from each other. This mounting assembly is similar in construction to mounting assembly 200 which was described in greater detail above.

As shown in FIGS. 1, 2 and 3, a pair of bias rails 290 and 292 are provided to keep an envelope in contact with the friction surface presented by belts 264 and 266 as the envelope moves through transport channel 262. Biased rail 290 is comprised of a pair of elongated metal bars 294 and 296 which extend outward from a common mounting post 298 in a parallel relationship. Mounting post 298 is in turn anchored to the structural frame of the apparatus. Guide rail 292 is likewise comprised of a pair of elongated metal bars 300 and 302 which are carried by mounting post 304. Mounting post 304 is in turn anchored to the structural frame of the apparatus.

Referring now to FIG. 3, a photosensor 306 and light source 308 are used to monitor the operation of the feeder apparatus. The photosensor and light source are located and oriented such that an envelope moving through transport channel 262 intercepts the light beam projected between them. Upon interruption of the light beam, the photosensor generates an electrical signal which is used by the control circuitry to monitor the progress of an envelope through the apparatus and to alert the stored section of the mail storing machine that an envelope is approaching.

With reference to FIGS. 3, 4, 5, 6, and 7, the various drive components of the feeder apparatus are driven by an electric motor 310. Electric motor 310 has a pulley 312 mounted on its drive shaft. A belt 314 is passed around pulley 312 and around a second pulley 316 which is mounted on horizontal shaft 272. In this way, motor 310 serves to drive shaft 272 such that belts 264 and 266 are continuously moving in a counterclockwise direction.

Figure 5:
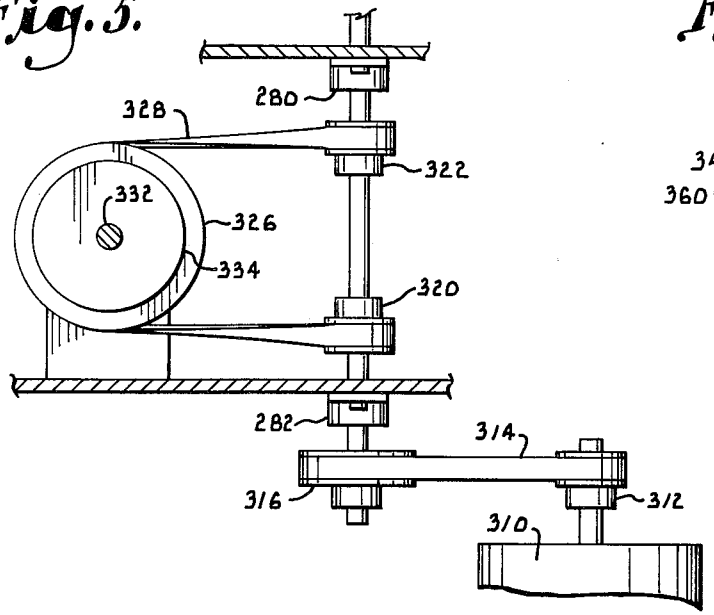
FIG. 5 is a fragmentary sectional view on an enlarged scale taken along line 5—5 of FIG. 4 in the direction of the arrows.

Vertical shaft 272 carries a pair of pulleys 320 and 322 which cooperate with a pair of pulleys 324 and 326 and belt drive 328 to impart rotational movement to an idler shaft 330. As shown in FIG. 5, belt 328 passes around pulley 322 before being twisted and passed around pulley 326. From pulley 326, the belt is twisted again and passed around pulley 320 before being twisted another time and drawn around pulley 324. The belt is then twisted a final time and passed back around the pulley 322.

Idler shaft 330 is in turn coupled with a primary drive shaft 322 through a clutch mechanism 334 which acts to selectively bring drive shaft 332 into engagement with idler shaft 330. In particular, this clutch mechanism is operable to remain in engagement for a prescribed period of time after the receipt of an activation signal.

Upon completion of this prescribed period, the clutch becomes disengaged and remains disengaged until it receives another activation signal. In this way, clutch mechanism 334 is operable to transfer rotatable movement to drive shaft 332 for a prescribed period of time after receipt of an activation signal.

Drive shaft 332 traverses the entire length of the apparatus and is rotatably mounted to the structural frame of the apparatus by means of flanged bearings 336, 338 and 340. The free end of idler shaft 330 is similarly coupled with the structural frame of the apparatus by means of a flanged bearings 342.

A beveled gear 344 is mounted to the free end drive shaft 332. This gear engages a beveled gear 346 which is mounted to vertical shaft 152 to impart rotational movement to the shaft. As shaft 150 rotates, the belt crank arm 146 causes pivot piece 136 to pivot about its pivot point due to the eccentric manner in which the bell crank arm is coupled to the shaft. This pivotal movement of the pivot bar is in turn impacted to the jogger arms to cause the arms to oscillate between air retracted and extended positions.

The rotatable movement of the primary drive shaft 332 is simultaneously transferred to a secondary drive shaft 348 by means of a sprocket 350 which is carried on primary drive shaft 332, a sprocket 352 which is mounted on secondary drive shaft 348 and a drive chain 354 which is drawn around these two sprockets. The secondary drive shaft 348 is in turn rotatably coupled with the structural frame of the apparatus by means of a plurality of flanged bearings 356, 358 and 360.

Figure 7:
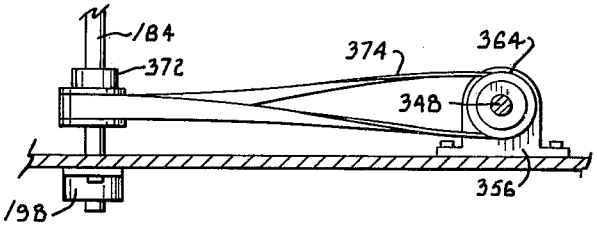
FIG. 7 is a fragmentary sectional view on an enlarged scale taken along line 7—7 of FIG. 4 in the direction of the arrows.

Drive shafts 112, 184 and 246 are all driven by the secondary drive shaft 348. Secondary drive shaft 348 carries a plurality of pulleys 362, 364 and 366 which are spaced apart along the length of the shaft at locations which coincide with drive shafts 112, 184 and 246, respectively. In particular, pulley 362 operates in combination with pulley 368 which is carried on shaft 112 and a belt 370 to transfer rotational movement from the secondary drive shaft to vertical shaft 112. Pulley 364, on the other hand, cooperates with a pulley 372 which is carried by shaft 184 and a drive belt 374 to transfer rotational movement from the secondary drive shaft to drive shaft 184. Finally, vertical shaft 246 carries a pulley 376 which cooperates with pulley 366 and a drive belt 378 to impart rotational movement to shaft 246 from the secondary drive shaft 348. The specific arrangement of each of these pulleys is shown in greater detail in FIG. 7. As shown in FIG. 7, the drive belt passes around the pulley which is carried by the secondary drive shaft. The belt is then twisted and passed around the pulley which is carried by the vertical drive shaft. From the pulley, which is carried by the vertical drive shaft, the belt is twisted once again before passing back around the pulley which is carried by the secondary drive shaft.

In operation, the carriage assembly 70 is moved away from the feed station to provide an open area between the feed station and the bias plate of the assembly. A quantity of envelopes is then deposited on magazine 12 in the manner shown in FIGS. 2 and 3. The envelopes are arranged against one another in vertical planes with their long bottom edges resting on the top surface of the magazine and their front surface facing forward toward the feed station. Each envelope has a sort code or other identifying data imprinted on it in an identical location. The sort code serves to indicate the sorting bin into which the envelope is to be deposited. The sorting mechanism is then programmed to match the various sort codes with the sorting bins of the machine. For example, if each envelope with a particular sort code is to be deposited in a particular sort bin, the machine's control circuitry is so programmed.

Once the envelopes have been deposited on the magazine, biased plate 72 is brought into contact with the last envelope of the stack. As shown in FIGS. 2 and 3, bias plate 72 forms an acute angle 76 with guide wall 48 of the magazine. The bias plate acts on the stack to maintain the envelopes in a slanted orientation relative to the guide wall. In particular, the angle between the envelopes and the guide wall is determined by the orientation of bias plate 72 relative to the guide wall.

The envelopes are driven along the magazine toward feed station 14 by means of the conveyor chains 50 whenever switch mechanism 158 detects the absence of an envelope in position at the feed station. As the conveyor chains force the stack of envelopes forward to the feed station, the leading envelope is brought in contact with contact arm 160 of switch mechanism 158. Thereafter, further forward movement of the stack by the conveyor chains causes the lead envelope to move the contact arm to an "off" position thereby placing switch mechanism 158 in an "off" condition. Placement of the switch mechanism 158 in a "off" condition in turn causes motor 56 to be shut off. Once a sufficient number of envelopes have been picked off the front of the stack by the feed station, contact arm 160 returns to the "on" position thereby returning the switch mechanism 158 to an "on" condition. The motor responds to this "on" condition by being energized and driving the stack of envelopes forward toward the feed station. In this way, motor 56 runs intermittently to maintain a supply of envelopes at the feed station but is shut off before the conveyor chains 50 have a chance to wear a hole in the bottom edge of the envelopes while they are being held stationary at the feed station.

When an entry is made on the keyboard 36, clutch 334 is engaged for a set duration corresponding to one revolution. During this time period, clutch 334 is engaged for a period of time sufficient to advance the lead envelope from the feed station 14 to a "dwell" position within transport channel 164. The envelopes remain in the dwell position until the apparatus advances another cycle. When the next entry is made on the keyboard, clutch 334 is engaged for another cycle during which the envelope is advanced from the dwell position to a read position at the read station. The envelope is then maintained in the read position until another entry is made on keyboard 36 by the operator of the apparatus.

Upon engagement of clutch 334, the primary drive shaft 332 and the secondary drive shaft 348 simultaneously begin to rotate. Rotation of the primary shaft causes drive shaft 150 to rotate which in turn causes the jogger arms 130 and 132 to oscillate between the retracted and extended positions. As drive shaft 150 rotates, belt crank arm 146 causes pivot piece 136 to continuously pivot about its pivot point 138 due to the eccentric manner in which the belt crank arm is coupled to shaft 150. The pivotal movement of the pivot piece in turn causes the jogger arm to oscillate between the retracted position wherein the arm sit within grooves in the face plate behind the friction surface of the conveying belt and their extended position wherein the arms protrude outward from the friction surface of the conveying belts. In the extended position, the jogger arms serve to push the entire stack of envelopes back away from the friction surface of the conveying belts 90 and 92. Movement of the entire stack of envelopes in this manner frees the leading envelope for easier separation of this envelope from the remainder of the stack.

Rotation of the secondary drive shaft 348, on the other hand, causes conveying belts 90 and 92 which are located at the feed station, conveying belts 174 and 176 which are located within transport channel 164 and conveying belts 226 and 228 which are located at the read station 16 to move in unison. As viewed in FIG. 3, conveying belts 90 and 92 move in a clockwise direction while belts 174, 176, 226 and 228 move in a counterclockwise direction.

At the feed station, section box 94 cooperates with its association conveying belts 90 and 92 to effectively separate the lead envelope from the remainder of the stack and to convey this envelope into transport channel 164 for transfer to the read station. Upon engagement of clutch 334, a grouping of holes 102 in conveying belts 90 and 92 begin to move in front of their corresponding opening in the face plate of the suction box just after the stack of envelopes has been pushed back away from the feed station. The low pressure within the suction box acts through these holes to draw the leading envelope toward the friction surface of the belts for conveyance away from the remainder of the stack. Conveying belts 90 and 92 are arranged to completely cover their corresponding suction openings to thereby prevent the suction effect created within the box from acting on the leading envelope unless a grouping of holes is positioned between the leading envelope and the suction openings of the box. In this way, the leading envelope is drawn against the conveying belts for movement away from the feed station only when a grouping of holes in each conveying belt is positioned between their suction openings and the leading envelope. By concentrating the suction force to such a small area, vacuum bleed through is virtually eliminated thereby facilitating separation of the envelopes by reducing the tendency of the suction device to simultaneously drawn two envelopes toward the conveying belts.

Movement of the leading envelope away from the feed station causes the leading edge of the envelope to come in contact with guide rail 166. As the envelope continues to move forward, the guide rail impedes further movement of the envelope in a forward direction causing it to be deflected into the transport channel 164 through an arcuate path. To reduce the arcuate path through which the envelopes must be moved, the friction surface of the conveying belts 90 and 92 form an obtuse angle with the transport channel. The envelopes are correspondingly advanced toward the feed station in a slanted orientation which coincides with the oblique orientation of conveying belts 90 and 92.

Once the envelope has been introduced into the transport channel 164, the bias rail acts to bring the side surface of the envelope into engagement with conveying belts 174 and 176. Engagement between the side surface of the envelope and conveying belts 174 and 176 causes the envelope to move through transport channel in unison with the conveying belts.

As the envelope enters the transport channel 164, clutch mechanism 334 becomes disengaged thereby terminating further movement of conveying belts 90, 92, 174, 176, 226 and 228. As a result, the envelope stops within the transport channel. This position of the envelope is referred to as the "dwell" position. The envelope remains in the dwell position until another entry is made on keyboard 36 by the operator of the apparatus. Upon receipt of another entry, clutch 334 becomes engaged thereby activating conveying belts 90, 92, 174, 176, 226 and 228. Activation of these conveying belts causes movement of the envelope through transport channel 164 to be resumed.

As the envelope approaches the read station, one of the grouping of holes 260 in each of the conveying belts 226 and 228 begins to move in front of their corresponding openings in suction box 230. The low pressure within the suction box acts through these holes to draw the leading envelope against the friction surface of the belts causing the envelope to move in combination therewith. The conveying belts then advance a distance sufficient to position the envelope in the read position at the read station. Coincident with the envelope reaching its designated position at the read station, clutch 334 becomes disengaged a second time thereby terminating further movement of conveying belts 90, 92, 174, 176, 226 and 228. As a result, the envelope is maintained in a stationary position at the read station. The envelope is held against the friction surface of conveying belts 226 and 228 by means of the low pressure within suction box 230 which acts through holes 260 in these belts to maintain the envelope in contact therewith. Since the envelope is held in place by means of the low pressure within suction box 230, the operator has an unrestricted view of the entire side surface of the envelope.

The operator reads the sort code or other data imprinted on the envelope and then makes an appropriate entry on keyboard 36. Upon receipt of this entry, the electronic control circuitry of the apparatus is placed in condition to direct the envelope to its designated sort bin and clutch mechanism 334 once again becomes engaged. Engagement of clutch 334 causes conveying belts 226 and 228 to begin moving in a counterclockwise direction. Movement of these belts in a counterclockwise direction causes the envelope positioned at the read station to be introduced into transport channel 262 for conveyance to the various sort bins of the machine. In transport channel 262 bias rails 290 and 292 serve to keep the side surface of the envelope in contact with conveying belts 264 and 266 which are moving continuously. In this way, the envelopes move through transport channel 262 in combination with these conveying belts. As the envelope moves through transport channel 262, it passes between photosensors 306 and light source 308. This photosensor is used to monitor the progress of an envelope through the apparatus and to indicate to the control circuitry that an envelope is approaching the storage section of the machine.

While an envelope is being conveyed from its dwell to read positions, another envelope is being picked off the stack at the feed station for conveyance to the dwell position where it is held until another entry is made on keyboard 36. To assure the proper operation of the apparatus, the operation of the jogger arms, conveying belts and clutch mechanism must be properly synchronized. In particular, the feder apparatus of the present invention is constructed to synchronize the operation of the jogger arms and conveying belts 90 and 92 such that the lead envelope of the stack is conveyed away from the feed station by the conveying belts 90 and 92 just after the jogger arms have pushed the entire stack of envelopes away from the feed station. This apparatus also synchronizes the movement of conveying belts 226 and 228 with the other belts so that belts 226 and 228 are properly arranged to grab an envelope as it approaches the read station. Finally, the apparatus synchronizes the operation of the clutch 334 with the movement of the conveying belts to locate the envelopes at the dwell and read positions as they move through the apparatus.

From the foregoing, it will be seen that this invention is one well adapted to obtain all ends and objects hereinabove set forth together with the other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. An envelope feeder apparatus for separating a plurality of envelopes from one another, said apparatus comprising:

magazine means for receiving a plurality of envelopes, said magazine means defining a straight path of travel for the envelopes along the entire length of the magazine means;

means for advancing the envelopes along said magazine means with each envelope in a plane oriented obliquely to said path of travel at all times while the envelope is in said magazine means;

a transport channel extending along at least a portion of said apparatus, said transport channel being disposed in a parallel relationship relative to said magazine means;

means for conveying envelopes through said transport channel;

separator means for separating said envelopes from one another and conveying said envelopes in succession from said magazine means to said transport channel, said separator means including a conveyer traveling in a path oblique to said transport channel and an adjacent end of said magazine means and parallel to the planes of the envelopes in the magazine means to convey the envelopes individually from said magazine means to said transport channel; and a substantially straight guide rail positioned to intercept the envelopes travelling along said conveyer, said guide rail extending from said conveyer to said transport channel at an obtuse orientation relative to the conveyer and channel to deflect and guide each envelope through a turn covering less than 90° from said conveyer to said transport channel.

2. The envelope feeder apparatus as in claim 1 wherein said separator means is comprised of:

at least one conveying belt moveably supported in proximity to said magazine means to provide said conveyor, said conveying belt presenting a friction surface which is capable of engaging the first envelope to be sorted so that movement of said conveying belt is operable to convey said first envelope away from the remaining envelopes in a set direction; and suction means for drawing said first envelope against the friction surface of said conveying belt.

3. The envelope feeder apparatus as in claim 2 wherein said conveying belt is located such that the friction surface of said conveying belt is in an oblique orientation relative to said transport channel and said magazine means.

4. The envelope feeder apparatus as in claim 3 including carriage means for maintaining the envelopes on said magazine disposed against one another in a substantially vertical plane, said carriage means being operable to orient the envelopes on said magazine means in a slanted position which coincides with the orientation of the friction surface of said conveying belt relative to said magazine means.

5. The envelope feeder apparatus as in claim 2 including:

switch means for detecting when the force exerted against the friction surface of said conveying belt by said envelopes to be sorted exceeds a preselected level; and means for inhibiting said advancing means whenever said switch means determines that said force exceeds said preselected level.

6. The feeder apparatus as in claim 2 including at least one jogger arm which is periodically operable to exert a force on the leading envelope to move the envelopes to be sorted away from the friction surface of said conveying belt.

7. The envelope feeder apparatus as in claim 2 wherein said suction means is comprised of a suction cavity having at least one opening defined therein, said suction cavity being positioned behind said conveying belt such that said conveying belt covers the opening in said suction cavity, and means for providing a relatively low pressure within said suction cavity.

8. The envelope feeder apparatus as in claim 7 wherein said conveying belt is provided with at least one hole which passes through said conveying belt to thereby allow the low pressure within said suction cavity to act through said hole to draw said first envelope against the friction surface of said conveying belt whenever said hole is positioned between the opening in said suction cavity and said first envelope.

9. An envelope feeder apparatus for separating a plurality of envelopes from one another, said apparatus comprising:

a structural frame presenting a magazine thereon, said magazine being adapted to receive a plurality of envelopes to be sorted;

means for advancing said envelopes to be sorted along said magazine to deliver the lead envelope to an envelope feed station;

a transport channel extending along at least a portion of said apparatus, said transport channel being disposed in a parallel relationship to said magazine;

means for conveying envelopes through said transport channel;

separator means located at the envelope feed station for separating the lead envelope from the remaining envelopes and conveying the lead envelope away from the envelope feed station along a path oriented obliquely to both the magazine and transport channel; and a substantially straight guide rail positioned to intersect the lead envelope as it is being conveyed away from said feed station by said separator means, said guide rail extending from said path to said transport channel at an obtuse orientation relative to the path and the channel to deflect and guide the lead envelope through a turn covering less than 90° from said path to said transport channel.

10. The envelope feeder apparatus as in claim 9 wherein said separator means is comprised of at least one conveying belt supported for movement on said frame in proximity to said feed station, said conveying belt presenting a friction surface which is capable of engaging the leading envelope so that movement of said conveying belt is operable to convey the lead envelope away from said envelope feed station in a set direction, and suction means for drawing the lead envelope against the friction surface of said conveying belt to convey the lead envelope away from said envelope feed station in a set direction.

11. The envelope feeder apparatus as in claim 10 wherein said conveying belt is supported for movement on said frame such that the friction surface of said belt is in an oblique orientation relative to said transport channel and said magazine.

12. The envelope feeder apparatus as in claim 11 including a carriage assembly for maintaining the envelopes on said magazine disposed against one another with each envelope located in a substantially vertical plane, said carriage assembly being further operable to orient the envelopes on said magazine in a slanted position which coincides with the orientation of the friction surface of said conveying belt relative to said magazine.

13. The envelope feeder apparatus as in claim 10 including:

switch means for detecting when the force exerted against the friction surface of said conveying belt by said envelopes to be sorted exceeds a preselected level; and means for inhibiting said advancing means whenever said switch means determines that said force exceeds said preselected level.

14. The feeder apparatus as in claim 10 including at least one jogger arm which is periodically operable to exert a force on the leading envelope to move the envelopes to be sorted away from the friction surface of said conveying belt.

15. The envelope feeder apparatus as in claim 14 wherein said suction means is comprised of a suction cavity having at least one opening defined therein, said suction cavity being positioned behind said conveying belt such that said conveying belt covers the opening in said suction cavity, and means for providing a relatively low pressure within said suction cavity.

16. The envelope feeder apparatus as in claim 15 wherein said conveying belt is provided with at least one hole which passes through said conveying belt to thereby allow the low pressure within said suction cavity to act through said hole to draw the lead envelope against said friction surface of said conveying belt whenever said hole is positioned between the opening in said suction cavity and the leading envelope.

17. In a mail sorting machine of the type operable to sort a plurality of envelopes in accordance with an indication thereon, the improvement of an envelope feeder apparatus comprising:

a structural frame presenting a magazine thereon, said magazine being adapted to receive a plurality of envelopes to be sorted;

means for advancing said envelopes to be sorted along said magazine to deliver the lead envelope to an envelope feed station;

a transport channel for receiving the envelopes and conveying the envelopes along the length of the transport channel, said transport channel defining an envelope path extending parallel to said magazine and spaced therefrom less than the length of the envelopes handled by the machine;

envelope supporting means located along said transport channel for holding an envelope in a vertical position such that an operator of the mail sorting machine has an unobstructed view of the entire side surface of the envelope being held by the envelope supporting means;

separator means located at said feed station for separating said envelopes from one another and conveying said envelopes in succession from said feed station to said transport channel along a path having an oblique orientation relative to both said magazine and said transport channel; and a guide rail positioned to intercept the envelopes and to deflect them through a turn of less than 90° into said transport channel.

18. The envelope feeder apparatus as in claim 17 wherein said separator means is comprised of at least one conveying belt supported for movement on said frame in proximity to said feed station, said conveying belt presenting a friction surface which is capable of engaging the leading envelope so that movement of said conveying belt is operable to convey said leading envelope away from said envelope feed station in a set direction, suction means for drawing the lead envelope against the friction surface of said conveying belt to convey the lead envelope away from said envelope feed station in a set direction, and said guide rail being positioned to intersect said lead envelope as it is being conveyed away from said feed station by said conveying belt, said guide rail being operable to impede forward movement of said lead envelope causing it to be bent and directed into said transport channel.

19. The envelope feeder apparatus as in claim 18 wherein said conveying belt is supported for movement on said frame such that the friction surface of said belt is in an oblique orientation relative to said transport channel and said magazine.

20. The envelope feeder apparatus as in claim 19 including a carriage assembly for maintaining the envelopes on said magazine disposed against one another with each envelope located in a substantially vertical plane, said carriage assembly being further operable to orient the envelopes on said magazine in a slanted position which coincides with the orientation of the friction surface of said conveying belt relative to said magazine.

21. The envelope feeder apparatus as in claim 19 including:

switch means for detecting when the force exerted against the friction surface of said conveying belt by said envelopes to be sorted exceeds a preselected level; and means for exhibiting said advancing means whenever said switch means determines that said force exceeds said preselected level.

22. The feeder apparatus as in claim 21 including at least one jogger arm which is periodically operable to exert a force on the leading envelope to move the envelopes to be sorted away from the friction surface of said conveying belt.

23. The envelope feeder apparatus as in claim 19 wherein said suction means is comprised of a suction cavity having at least one opening defined therein, said suction cavity being positioned behind said conveying belt such that said conveying belt covers the opening in said suction cavity, and means for providing a relatively low pressure within said suction cavity.

24. The envelope feeder apparatus as in claim 23 wherein said conveying belt is provided with at least one hole which passes through said conveying belt to thereby allow the low pressure within said suction cavity to act through said hole to draw the lead envelope against said friction surface of said conveying belt whenever said hole is positioned between the opening in said suction cavity and the leading envelope.

25. The envelope feeder apparatus as in claim 17 wherein said envelope supporting means is comprised of at least one conveying belt supported for movement on said frame adjacent to said transport channel, said conveying belt presenting a friction surface which is aligned with said transport channel, and suction means for drawing an envelope emerging from said transport channel against the friction surface of said conveying belt to cause the envelope to move in combination with said conveying belt.

26. The envelope feeder apparatus as in claim 25 wherein said suction means is comprised of a suction cavity having at least one opening defined therein, said suction cavity being positioned so that said conveying belt covers said opening in said suction cavity, means for providing a relatively low pressure in said suction cavity.

27. The envelope feeder apparatus as in claim 26 wherein said conveying belt is provided with at least one hole which passes through said belt to thereby allow the low pressure within said suction cavity to act through said hole to draw an envelope against the friction surface of said conveying belt whenever said hole is positioned between the opening in said suction cavity and the envelope.

28. The envelope feeder apparatus as in claim 25 including means for inhibiting movement of said conveying belt whenever an envelope held by said envelope support means reaches a preselected position.

* * * * *